US005456311A

United States Patent [19]

Knecht et al.

[11] Patent Number: 5,456,311

[45] Date of Patent: Oct. 10, 1995

[54] HEAT EXCHANGER

[75] Inventors: Wolfgang Knecht, Filderstadt; Roland Strähle, Unterensingen; Gerhard Weiss, Nürtingen—Zizishausen, all of Germany

[73] Assignee: Längerer & Reich GmbH & Co., Filderstadt, Germany

[21] Appl. No.: 230,913

[22] Filed: Apr. 21, 1994

Related U.S. Application Data

[63] Continuation of Ser. No. 042,162, Apr. 2, 1993, Pat. No. 5,345,674.

[30] Foreign Application Priority Data

Apr. 16, 1992 [DE] Germany ..... 42 12 717.3

[51] Int. Cl.[6] ..... F28F 9/16

[52] U.S. Cl. ..... 165/175; 165/151; 165/173

[58] Field of Search ..... 165/151, 153, 165/173, 175; 29/890.043, 890.044

[56] References Cited

U.S. PATENT DOCUMENTS

| | | | |
|---|---|---|---|
| 1,116,426 | 11/1914 | Holz | 165/177 |
| 1,410,561 | 3/1922 | Forseille | 165/159 |
| 1,457,768 | 6/1923 | Curran | 165/148 |
| 1,486,556 | 3/1924 | Witte | 165/174 |
| 1,618,485 | 2/1927 | Skinner | 165/151 |
| 3,583,478 | 6/1971 | Fieni | 165/178 |
| 4,226,280 | 10/1980 | Hellouin De Cenival et al. | 165/173 |
| 4,401,157 | 8/1983 | Cadars | 165/173 |
| 4,682,650 | 7/1987 | Potier | 165/173 |
| 4,730,669 | 3/1988 | Beaseey et al. | 165/153 X |
| 4,967,836 | 11/1990 | Nakamura | 165/173 |
| 5,101,561 | 4/1992 | Fuhrmann et al. | 29/890.043 |
| 5,219,024 | 6/1993 | Potier | 165/173 |

FOREIGN PATENT DOCUMENTS

| | | | |
|---|---|---|---|
| 2567247 | 1/1986 | France | 29/890.044 |
| 130997 | 8/1983 | Japan | 165/153 |
| 2055064 | 2/1981 | United Kingdom | 29/890.044 |
| 2122928 | 1/1984 | United Kingdom | 29/890.044 |

*Primary Examiner*—Martin P. Schwadron
*Assistant Examiner*—L. R. Leo
*Attorney, Agent, or Firm*—Michael J. Striker

[57] ABSTRACT

In a heat exchanger having a heat exchanger network with a plurality of tubes and at least one base plate having a plurality of passages for tube ends, the passages in the base plate are substantially triangular.

27 Claims, 3 Drawing Sheets

Fig. 2
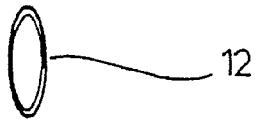
Fig. 1
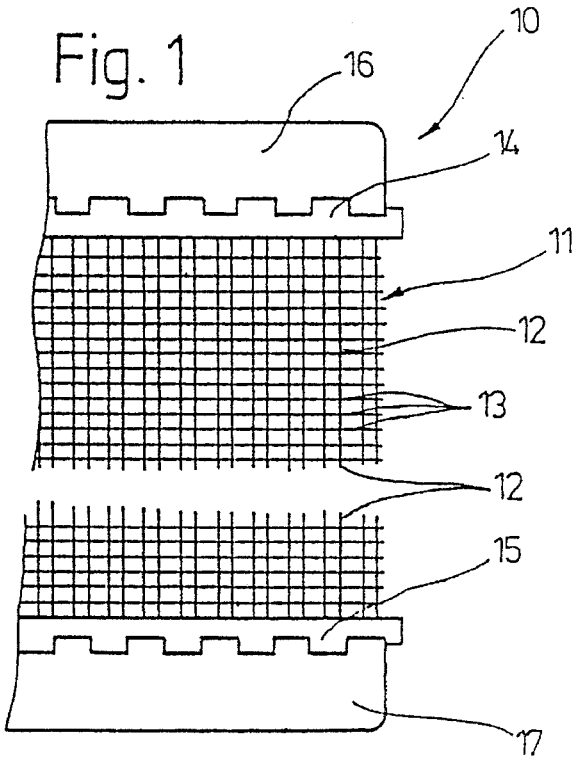
Fig. 3
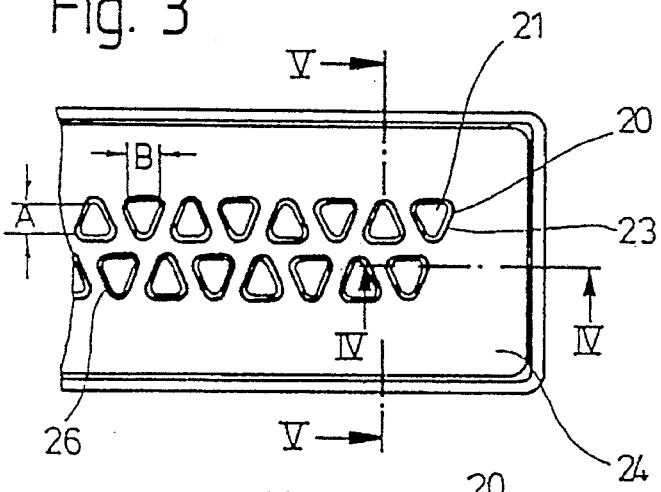
Fig. 4
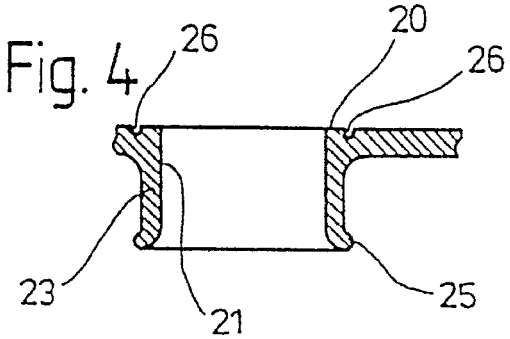
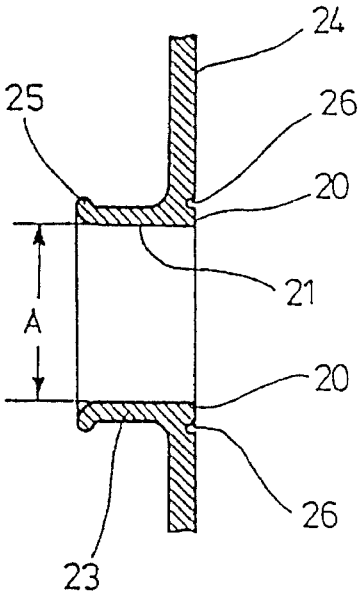
Fig. 5

Fig. 6
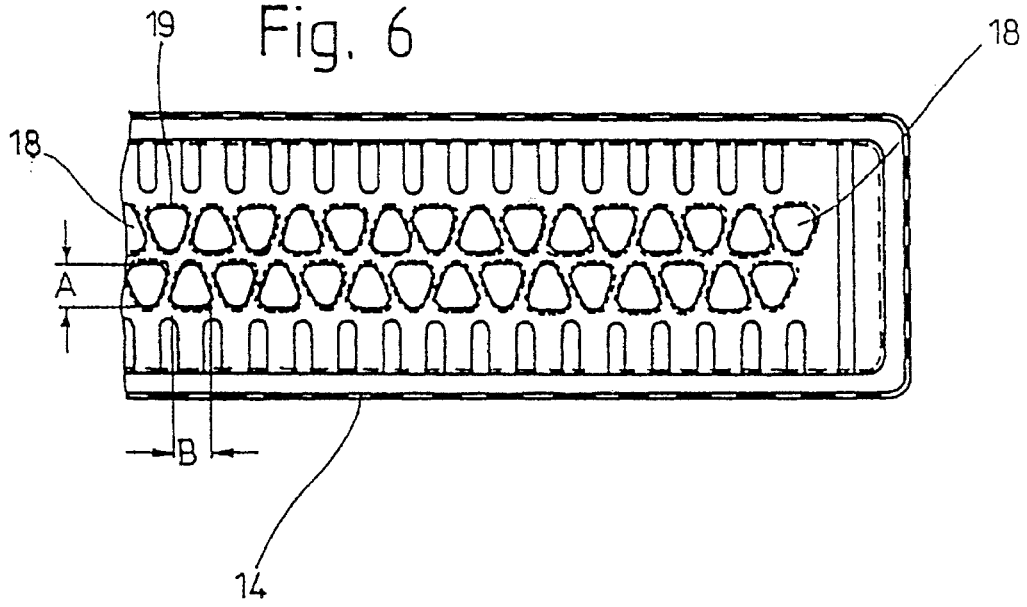
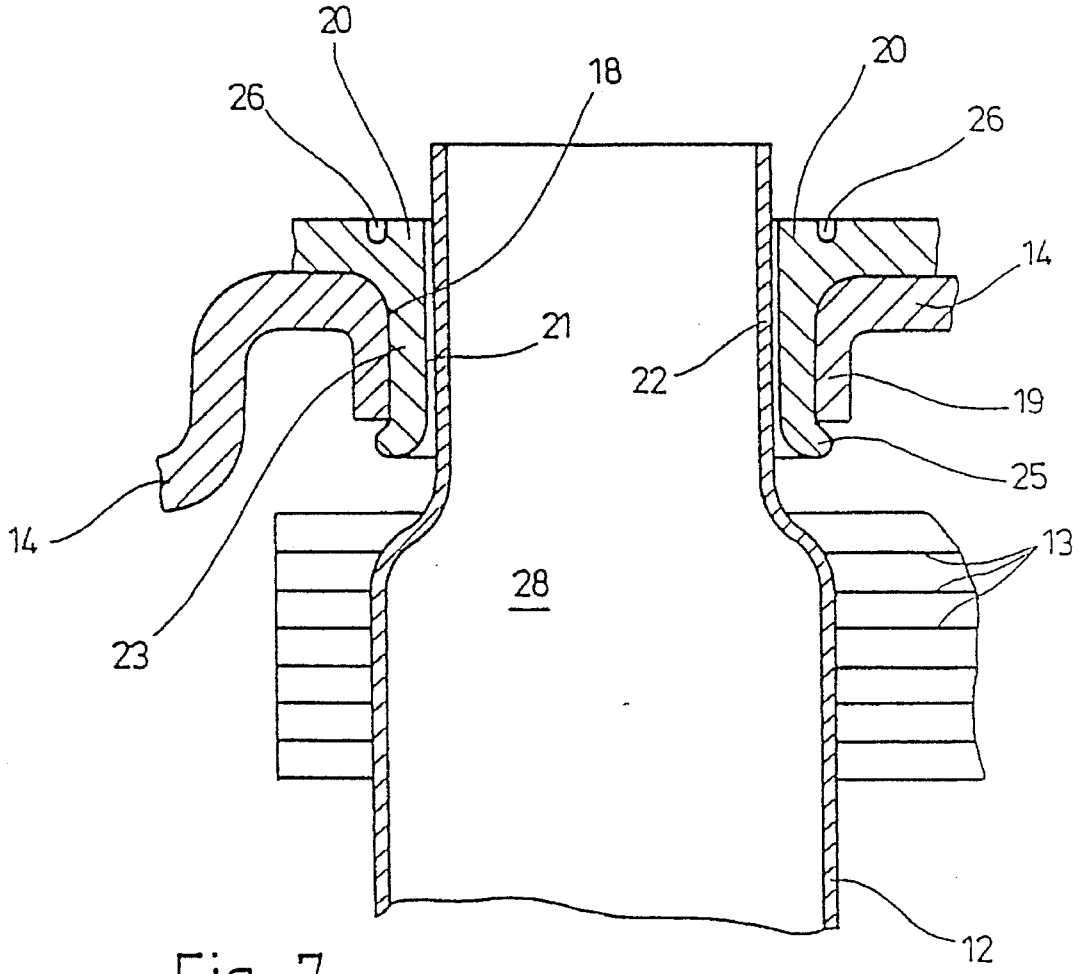
Fig. 7

HEAT EXCHANGER

This is a continuation of application Ser. No. 08/042,162 filed Apr. 2, 1993 now U.S. Pat. No. 5,345,674.

BACKGROUND OF THE INVENTION

The present invention relates generally to heat exchangers. More particularly, it relates to a heat exchanger which has a plurality of tubes having tube ends which extend through at least through one base plate and are sealed by corresponding seals.

Heat exchangers of the above mentioned general type are known in the art. In the known heat exchanger the oval tube ends are connected by expansions of the oval to another oval with the base plate. The base plates in the region of their passages are provided with collars projecting to one side and increasing the abutment surface. This however has the disadvantage that the base plates have a relatively low bending strength. It is also required to select the material thickness of the base plate relatively great, and this increases the weight of the heat exchanger as a whole. For increasing the bending strength steel is utilized as a material for the base plate, naturally it must be provided with a corrosion protective layer. This causes recycling problems, and the materials are very expensive.

Another disadvantage of such heat exchanger is that the transition region between the expanded oval tube ends and the remaining tube region is vulnerable since transverse forces cannot be taken efficiently in the transition region. During mounting it is necessary to take measures to avoid certain damage to the heat exchanger.

SUMMARY OF THE INVENTION

Accordingly, it is an object of the present invention to provide a heat exchanger of the above mentioned general type, which avoids the disadvantages of the prior art.

More particularly, it is an object of the present invention to provide a heat exchanger in which the base plate has a greater bending strength and therefore can be produced so that its cross-sectional thickness is smaller and its material is lighter and does not need special corrosion protection.

In keeping with these objects and with others which will become apparent hereinafter, one feature of the present invention resides, briefly stated, in a heat exchanger in which passages in the base plate for the tube ends are substantially triangular.

Due to the triangular design of the passages, and particularly the collars, the base plate obtains a considerable increase of the bending strength. The material thickness of the base plate therefore can be reduced without loss of strength. This leads to a cost saving and a weight reduction, which is particularly desired for example in the motor vehicles. Further, despite low material thickness aluminum can be used as a material for the base place. It provides simultaneously a corrosion protection and does not need a special corrosion protection layer, at the same time it has advantageous recycling properties. The triangular shape of the passages of the sealing elements, particularly the sealing collars, leads to an increased design strength of the sealing elements. Thereby their mounting is simplified and a greater safety against faulty mounting, spoilage and the like is provided. Due to the triangular form of the passages in the base plates, on the one hand, and the sealing collars on the other hand, a form-locking mounting position is obtained.

The triangular contour of the tube ends leads in advantageous manner to a stable and rigid transition region to oval regions of the tubes for the heat exchanger network. Forces and other loads occurring during the mounting and in operation are transferred from this sensitive region. Due to the triangular contour transverse forces are taken better.

In accordance with another feature of the present invention, the base plate is provided with two rows of substantially triangular passages which extend substantially parallel to one another and are offset in a longitudinal direction by a half passage. When the heat exchanger is designed in accordance with this feature, in a place-economical manner the base plate can be provided with several passages and thereby the number of the tubes with the same size of the base plate can be substantially increased. This leads to an increase in the heat exchanger efficiency. With a predetermined tube number, the size of the base plate can be reduced and a compact heat exchanger can be produced.

It is another feature of the present invention to provide a method tight mounting of a base plate on the heat exchanger network, in accordance with which the above mentioned advantages are provided. In the inventive method the cross-sections of the tube ends before their insertion and expansion are shaped to a triangular contour.

When the method is designed in accordance with the present invention the manufacture of the heat exchanger is simplified. A cost reduction and a quality increase are also obtained.

The substantially triangular tubular ends can be expanded to obtain a tulip shape. Due to the additional, substantially tulip-shaped expansions, funnel-like cross-sectional expansions are obtained and therefore the inflow-pressure losses can be reduced in advantageous manner. As a result with lower pump output a higher mass flow of the cooling medium is obtained. Moreover, the tubes with such tube ends act as pulling braces on the base plate. The reason is that the inclined tube wall regions formed by the additional tulip-shaped expansion apply through the sealing element a normal force to the base plate. Additional auxiliary means for position securing, for example supports, frames and the like are arranged laterally of the heat exchanger network and connected with the base plate or the cover, collector container, water box and the like, are therefore not needed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a schematic side view of a part of a heat exchanger in accordance with the present invention;

FIG. 2 is a schematic section of an oval tube of the inventive heat exchanger of FIG. 1;

FIG. 3 is a plan view of a sealing plate of the heat exchanger of FIG. 1 in accordance with the present invention;

FIGS. 4 and 5 are schematic sections taken alone the lines IV—IV and V—V in FIG. 3;

FIG. 6 is a schematic plan view of a part of the base plate of the inventive heat exchanger of FIG. 1;

FIG. 7 is a schematic section substantially corresponding to the line V—V of an upper part of the inventive heat exchanger of FIG. 1 in an intermediate phase of manufacture with inserted tube ends which are however not yet expanded;

DESCRIPTION OF THE PREFERRED EMBODIMENTS

Figure 10:
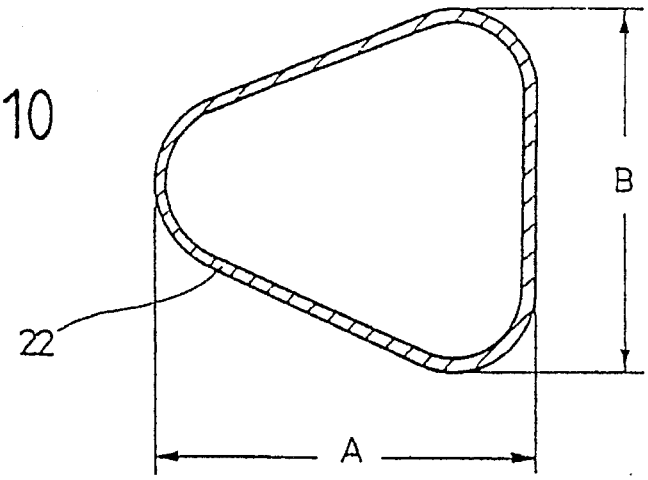
FIG. 10 is a schematic section of an expanded tube end having a triangular shape, in accordance with an embodiment which is different from the embodiment of FIG. 9.

FIG. 1 is a view schematically showing a heat exchanger which is identified with reference numeral 10 and can be formed as a cooler, and particularly a water cooler for internal combustion engines and the like. The heat exchanger 10 has a schematically shown heat exchanger network 11 composed of a plurality of tubes 12 which, as shown in FIG. 2, have for example an oval cross-section. The heat exchanger network 11 further has a plurality of for example substantially plate-shaped guiding sheets 13 which extend substantially parallel to and at a distance from one another and are provided with oval openings corresponding to the tubes 12. Therefore the tubes 12 can pass through the openings. The openings can be extended by coaxial not shown collars which increase the abutment surface of the tubes 12. The tubes 12 which have for example an oval cross-section are connected with the guiding sheets 13. In particular the tubes 12 are inserted into a pack of guiding sheets 13 and then the oval tubes are expanded so as to provide a firm clamping connection. The tubes 12 can be for example expanded so that their greater diameter and their smaller diameter are increased. For example the diameter ratio with the magnitude of substantially 3.8:1 is reduced to a diameter ratio of substantially the magnitude of 3.6:1.

The heat exchanger 10 further has at least one base plate. In the embodiment shown in FIG. 1 the heat exchanger has an upper base plate 14 and a lower base plate 15. The base plates are identical and therefore further details of the base plates will be explained with respect to the upper base plate 14. Both base plates 14 and 15 are mounted on the facing ends of the tubes 12 by expansion and thereby are durably and tightly connected. Each base plate 14, 15 is tightly connected with a cover 16 or 17 of a collector box in known manner.

The tubes 12, the guiding sheets 13, and at least base plate 14, 15 are composed for example of aluminum. The durable and tight connection between the base plates 14, 15 at the ends of the tubes 12 is performed by clamping and therefore no soldering is needed.

Figure 8:
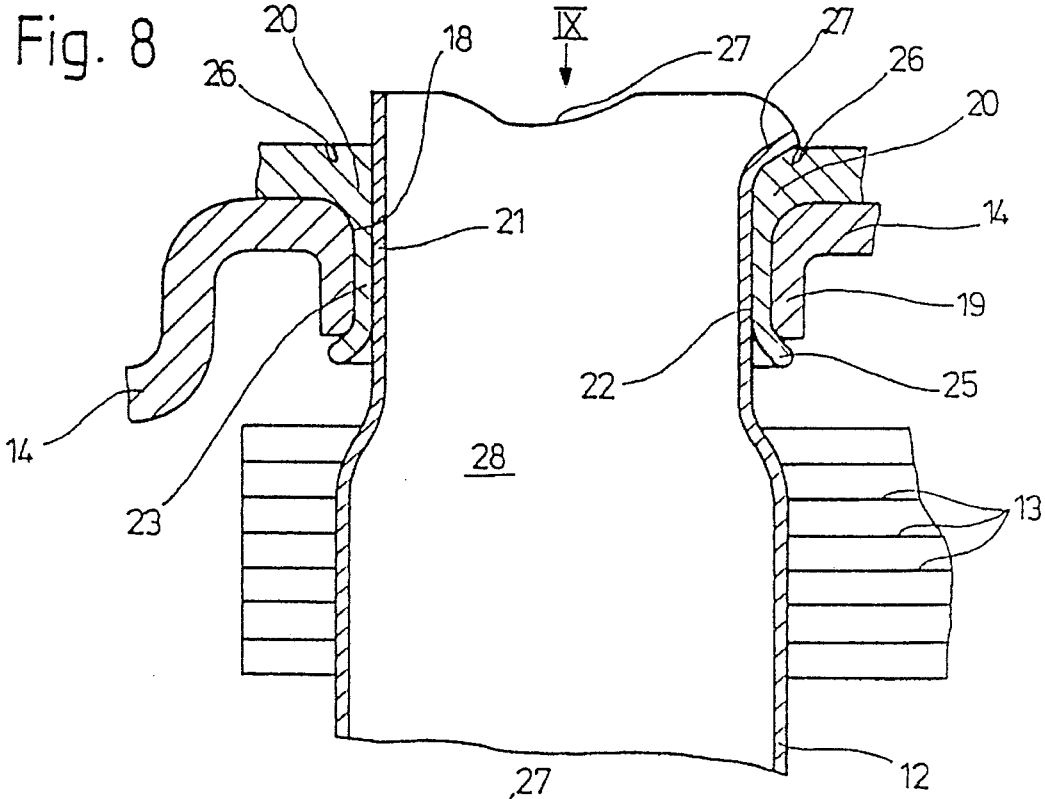
FIG. 8 is a schematic section substantially corresponding to the section shown in FIG. 7, after the expansion of the tube ends.

As can be seen from the example for the upper base plate 14 shown in FIGS. 6–8, the base plate 14 has a plurality of passages 18 all having a substantially triangular shape. In accordance with an especially advantageous feature each base plate 14, 15, as shown in FIGS. 6–8 for the base plate 14, can be provided in the region of the passages 18 with collars 19 extending to one side. The collars 19 can have also a substantially triangular shape. The collars 19 face for example toward the heat exchanger network 11. They are formed as a one-piece component of the base plate 14 and produced for example as rim holes. In accordance with another, not shown embodiment, the collars 19 are dispensed with, and the base plates 14, 15 are provided with passages 18 which extend through the cross-sectional thickness and as shown in FIGS. 7 and 8 through the cross-sectional thickness of the base plate 14 and the length of the collar 19. As can be seen from FIG. 6, the base plate 14 has two substantially parallel rows of substantially triangular passages 18. Both rows are offset in the longitudinal direction by a half passage 18. In each row the passages 18 are arranged so that a corner of the triangle is offset by 180° in a peripheral direction in alternating order. For example, as can be seen in FIG. 6 the right passage 18 has the corner of a triangle extending downwardly, while the next passage 18 has the corner of the triangle extending upwardly. Thereby a great number of the passages 18 can be provided in the base plates 14, 15 so that heat exchanger 10 with the same dimensions has a greater number of the tubes 12 and thereby a greater output. With the same number of the tubes 12, the total size of the heat exchanger can be reduced and therefore a compact heat exchanger 10 can be obtained. In accordance with another not shown embodiment, instead of two rows of the passages 18 as shown in FIG. 6, only one row of the passages 18 is provided, or three or more rows of the passages 18 can be provided as well.

The ratio of the height A to the base B of the triangle of each passage 18 of the base plate 14 is greater than 1 and for example is of the magnitude between 1.01 and 1.1. The corresponding triangular shape of the passage 18 is formed for example by an isosceles triangle, and the corners of the triangle are rounded.

The base plates 14 and 15 at the side which faces away of the heat exchanger network 11 are provided with sealing elements. In the drawings the sealing elements 20 of the upper base plate 14 are illustrated. The sealing elements 20 have throughgoing openings oriented to the corresponding passages 18. In the finished state of the heat exchanger 10 shown in FIG. 8, they are provided with sealing collars 23 which extend in the passages 18 and surround the throughgoing tube ends 22. The collars 23 are one piece components of the sealing elements 20. In accordance with an advantageous feature, the sealing elements 20 can be formed of one piece for example on one sealing plate 24 which completely overlaps the base plate 14, or on several small plates. The individual throughgoing openings 21 of the sealing element 20 are also substantially triangular as the passages 18. In particular, the sealing collar 23 of the sealing element 20 can be provided with a substantially triangular cross-section.

In conditions shown in FIG. 7 and before the mounting of the base plate 14 by expansion of the tube ends 22, the sealing collars 23 which have substantially the same shape as the passages 18 and for example correspond to the inner contour of the collars 19, engage in the passages 18 in form-locking manner. Also, the triangular shape of the throughgoing openings 21, in particular the sealing collars 23, is selected in correspondence with the shape of the passages 18 so that the throughgoing openings 21 have for example the shape of an isosceles triangle with preferably rounded corners. Each sealing collar 27 projects outwardly beyond the collar 19 of the base plate 14. A projecting edge portion 25 is oriented outwardly as shown in FIGS. 4, 5 and 7. During expansion of the throughgoing tube end 22 (FIG. 8) it is deformed from inside outwardly and pressed against the passage 18, in particular against the downwardly located edge of the collar 19 in FIG. 8 so as to engage with its end over the collar 19.

The outer size of the sealing collar 23 of each sealing element 20 corresponding to the inner size of the corresponding passage 18, in particular the collar 19, of the base plate 14 at least substantially. The ratio of the height A to the base B of the triangle of each throughgoing opening 21 of the sealing element 20 in not deformed condition shown in FIGS. 3 and 7 can be greater than 1, for example the ratio can be with the magnitude between 1.01 to 1.1. The sealing elements at the side opposite to the sealing collar 23 have a circular depression 26 which extends substantially triangularly along a triangle line following the triangular outer contour of the sealing collar 23. In the condition of the sealing elements 20 when they are not yet pressed by expanding the tube ends 22, the depression 26 has its original width as shown in FIG. 7. After expansion of the tube ends 22 and compressing of the sealing element 20, the depression 26 almost disappears as shown in FIG. 8. Due to the depression 26 the adjoining upper edge region of the sealing element 20 located between the inserted tube end 22 and the depression 26 can yield during expansion of the tubular end 22 and compressing of the sealing element 20 and move upwardly.

Figure 9:
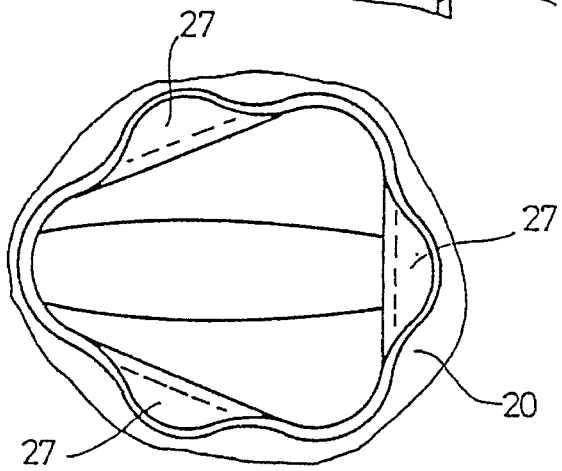
FIG. 9 is a schematic view of the expanded tube end as seen in the direction of arrow IX in FIG. 8.

The tubes 12 which are oval in the region of the heat exchanger network 11, have tube ends 22 with a substantially triangular cross-section. These triangular tube ends 22 are produced by deforming of the tube ends having an oval cross-section in the heat exchanger network 11, to obtain the triangular shape. During the deformation the size of the greater diameter of the oval tube can be considerable reduced to the height A of the tube end 22 having a substantially triangular cross-section, while the smaller diameter of the oval tube can be substantially reduced to the base size B. The value for the base B can be for example the 2–2.5 times the smaller diameter of the oval tube. The greater diameter which corresponds to the height A of the triangular tubular tube end 22 can be reduced for example substantially by the factor 0.7–0.75. During the mounting of the base plate 14 on the tube ends deformed to a substantially triangular cross-section, the tube ends extend through the sealing collar 23 inside the collars 19, and the tube ends 22 extend upwardly beyond the sealing elements 20 as shown in FIG. 7. The tube ends having a substantially triangular cross-section are expanded from inside outwardly while their triangular shape is maintained as shown in FIG. 8. The corresponding sealing element 20 is compressed in correspondence with the degree of the expansion, for example substantially by 50% as can be seen on the reduced cross-section of the sealing collar 23 in FIG. 8. The tube ends 22 having a substantially triangular cross-section are expanded for example so that the height A and the base B are increased. Such an expanded tube end 22 which however maintains the triangular cross-section, is shown in FIG. 10. Contrary to this, it can be advantageous when during expansion of substantially in the region of the longitudinal center at least one triangular side has a a further expansion from inside outwardly with a convexity as shown in FIG. 9 for all three triangular sides and identified with reference numeral 27. When all three triangle sides are additionally expanded and bulged out in this way from inside outwardly, a substantially tulip-shaped design is produced.

In order to produce a tight mounting of the base plate 14 on the heat exchanger network 11 for example for manufacturing the heat exchanger 10, after producing the heat exchanger network 11 in the above described manner with the tube ends 22 having an oval cross-section, the oval tube ends are deformed to a substantially triangular contour. This can be done by inserting a mandrel with or without a counter support. Therefore a transition region 28 is produced, which forms the transition between the oval cross-section and the substantially triangular cross-section of the tube ends 22. The guiding sheets 13 located in the transition region 28 are adjusted by deformation to the corresponding deformation in the transition region 28. After the deformation of the tube ends 22 to a substantially triangular cross-section, the tube ends 22 are guided into the throughgoing openings 21 of the sealing element 20 and inserted as shown in FIG. 7. As a result an expansion of the tube ends 22 is provided in all directions transverse to the longitudinal direction of the tubes. The triangular tube ends 23 are expanded triangularly and abut tightly against the sealing collar 23 as shown in FIG. 8. With this triangular expansion of the triangular tubular ends 22, simultaneously a substantially tulip-shaped expansion in the region of the triangle sides can be obtained with formation of the bulges 27. This can be performed in a deformation stage and therefore with the same working step. Instead, the tulip-shaped expansion can be produced in a subsequent stage after the expansion of the triangular tube ends 22.

The cross-section change and subsequent expansion of the tube ends 22 is performed so that, starting from an oval cross-section with a diameter ratio of at least 3:1, the triangular expanded tube ends 22 have a ratio of the height A to the base B of for example 1.05:1 to 1.1:1. In this case especially favorable deformation conditions and high strength is obtained with durable and tight mounting without the danger of damage to the tube material in particular the damage of cracks and the like.

Since in the base plates 14, 15 the passages 18 and in particular the collars 19 are substantially triangular, the bending strength of the base plate 14, 15 is substantially increased. This has the advantage that the material thickness of the base plate 14, 15 is reduced, and this leads to a weight and cost saving. In particular a weight saving is desired in many applications of the heat exchanger, for example in motor vehicles. It is of a further advantage that due to the increased bending strength for the base plate 14, 15 aluminum can be used instead of steel. This leads also to a weight reduction. Moreover, the base plates 14, 15 of aluminum are not corrosion-susceptible. Therefore in contrast to the base plates composed of steel no corrosion protection coating is needed, which is expensive and also involves recycling problems. Therefore the heat exchanger 10 has advantageous recycling properties.

The triangular throughgoing openings 21, in particular the sealing collars 23 of the sealing element 20 have the advantage that the sealing elements 20 can have a greater structural strength. An easy and reliable mounting of the sealing elements 20 in the corresponding base plate 14, 15 is therefore possible. Since both the passages 18 and the sealing collars 23 have a substantially triangular shape, the mounting position is obtained in form-locking manner and therefore is facilitated.

Since the tube ends engaging in the base plates 14, 15 have a substantially triangular cross-section, a stable and stiff transitional region 28 to the heat exchanger network 11 is obtained with the tubes 12 having an oval cross-section. Forces and other loads which occur during the mounting and in operation are reliably transferred from this sensitive region. The triangular contour of the tube ends has further the advantage that these transverse forces are taken up better.

When during the mounting of the triangular tube ends 22 by expansion additionally a substantially tulip-shaped expansion is produced with forming the bulges 27, several additional advantages are provided. The additional three expansions formed by the bulges 27 with inclined tube regions at the triangular tube ends 22 produce a funnel-shaped cross-sectional expansion. Such an expansion has the advantage that the inflow-pressure loss portion of the flowing in and flowing through medium is reduced. Low flow pressure losses of the cooling medium in operation are obtained, and therefore with a lower pump output a higher mass throughput of the cooling medium can be provided. It is further advantageous that the tube ends expanded in the above described manner operate as pulling braces on the base plates 14, 15. The reason is that the inclined tube wall regions produced by the bulges 27 as shown for example in FIG. 8 apply through the corresponding sealing element 20 a normal force to the corresponding base plate 14, 15. Additional measures for position securing of the corresponding base plate 14, 15 with the covers 16 or 17 apply on it, with respect to the heat exchanger network 11 including the tubes 12 and the guiding sheets 13, are not needed. For example supports, frames and the like mounted laterally on the heat exchange network 11 and connected with the base plates 14, 15 or the covers 16, 17 as auxiliary means for position securing can be dispensed with for the reasons presented hereinabove.

It will be understood that each of the elements described above, or two or more together, may also find a useful application in other types of constructions and methods differing from the types described above.

While the invention has been illustrated and described as embodied in a heat exchanger and a method of producing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed and desired to be protected by Letters Patent is set forth in the appended claims:

1. A heat exchanger, comprising a heat exchanger network having a plurality of tubes with tube ends; at least one base plate mounted on said tube ends by expanding said tube ends and having a plurality of passages for said tubes, said passages of said base plate being substantially triangular, said substantially triangular passages in said base plates being arranged so that corners of adjacent passages are offset relative to one another in the peripheral direction by substantially 180° in an alternating order; and a plurality of sealing elements having throughgoing openings corresponding to said passages of said base plate and provided with sealing collars which are located in said passages and surround said tube ends, said tube ends which extend through said sealing openings of said sealing elements while maintaining their triangular shape and are expanded from inside-outwardly, and also in the region of a longitudinal center of at least one triangle side being further expanded from inside outwardly so as to bulge out.

2. A heat exchanger, comprising a heat exchanger network having a plurality of tubes with tube ends; at least one base plate mounted on said tube ends by expanding said tube ends and having a plurality of passages for said tubes, said passages of said base plate being substantially triangular, said substantially triangular passages in said base plates being arranged so that corners of adjacent passages are offset relative to one another in the peripheral direction by substantially 180° in an alternating order; and a plurality of sealing elements having throughgoing openings corresponding to said passages of said base plate and provided with sealing collars which are located in said passages and surround said tube ends, said tube ends extending through said throughgoing openings of said sealing elements while maintaining their triangular shape and are expanded from inside outwardly, and also in the region of a longitudinal center of all triangle sides are expanded further inside outwardly and bulged out to provide a substantially tulip shape.

3. A heat exchanger, comprising a heat exchanger network having a plurality of tubes with tube ends; at least one base plate mounted on said tube ends by expanding said tube ends and having a plurality of passages for said tubes, said passages of said base plate being substantially triangular; and a plurality of sealing elements having throughgoing openings corresponding to said passages of said base plate and provided with sealing collars which are located in said passages and surround said tube ends, said tube ends which extend through said sealing openings of said sealing elements while maintaining their triangular shape and are expanded from inside outwardly, and also in the region of a longitudinal center of at least one triangle side being further expanded from inside outwardly so as to bulge out.

4. A heat exchanger, comprising a heat exchanger network having a plurality of tubes with tube ends; at least one base plate mounted on said tube ends by expanding said tube ends and having a plurality of passages for said tubes, said passages of said base plate being substantially triangular; and a plurality of sealing elements having throughgoing openings corresponding to said passages of said base plate and provided with sealing collars which are located in said passages and surround said tube ends, said tube ends extending through said throughgoing openings of said sealing elements while maintaining their triangular shape and being expanded from inside outwardly, and also in the region of a longitudinal center of all triangle sides are expanded further inside outwardly and bulged out to provide a substantially tulip shape.

5. A heat exchanger as defined in claim 3, wherein said throughgoing openings of said sealing elements are substantially triangular.

6. A heat exchanger as defined in claim 3, wherein said sealing collars of said sealing elements have a substantially triangular cross-section.

7. A heat exchanger as defined in claim 3, wherein said base plates in the region of said passages have collars which extend toward one side of each of said base plates and have a substantially triangular cross-section.

8. A heat exchanger as defined in claim 3, wherein said substantially triangular passages are arranged in two substantially parallel rows so that they are offset by a half passages as considered in a longitudinal direction of said rows.

9. A heat exchanger as defined in claim 3; and further comprising a sealing plate which at least partially overlaps said base plate and formed so that said sealing elements are of one piece with said sealing plate and so that said sealing collars having a substantially triangular cross-section have the same shape as said passages and engage in said passages.

10. A heat exchanger as defined in claim 3, wherein said sealing elements at a side which is opposite to said sealing collars are provided with a substantially circular depression which extends substantially along a triangle line following a triangular outer contour of said sealing collars.

11. A heat exchanger as defined in claim 3, wherein said base plate in the region of said passages has collars which project at one side and have a substantially triangular cross-section, said sealing collars of said sealing element extending outwardly beyond said collars of said base plate.

12. A heat exchanger as defined in claim 11, wherein said sealing collars which during expansion of said tube ends are deformed from inside outwardly and pressed against said passage have an end which engages over an edge of a passage.

13. A heat exchanger as defined in claim 12, wherein said sealing collar is pressed against said collars of said base plate and engage over said collars of said base plate.

14. A heat exchanger as defined in claim 13, wherein said sealing collars have an outer side at least substantially corresponding to an inner side of said collars of said base plate.

15. A heat exchanger as defined in claim 12, wherein said sealing collars have an outer size at least substantially corresponding to an inner size of said passages of said base plate.

16. A heat exchanger as defined in claim 3, wherein said passages of said base plate have substantially the shape of an isosceles triangle.

17. A heat exchanger as defined in claim 16, wherein said isosceles triangle has corners which are rounded.

18. A heat exchanger as defined in claim 3, wherein said throughgoing openings of said sealing elements have substantially the shape of an isosceles triangle.

19. A heat exchanger as defined in claim 18, wherein said isosceles triangle has corners which are rounded.

20. A heat exchanger as defined in claim 18, wherein each of said throughgoing openings of said sealing elements in not deformed condition has the shape of a triangle with a ratio of a height to a base of greater than 1.

21. A heat exchanger as defined in claim 20, wherein said triangle has the ratio of the height to the base of between 1.01 and 1.1.

22. A heat exchanger as defined in claim 3, wherein each of said passages of said base plate has the shape of a triangle with a ratio of a height to a base greater than 1.

23. A heat exchanger as defined in claim 22, wherein said triangle has the ratio of the height to the base between 1.01 and 1.1.

24. A heat exchanger as defined in claim 3, wherein said tube ends have a substantially triangular cross-section.

25. A heat exchanger as defined in claim 3, wherein said tubes have an oval cross-section and said tube ends are deformed so as to have a triangular shape.

26. A heat exchanger as defined in claim 3, wherein said tube ends extend through said throughgoing openings of said sealing elements while maintaining their triangular shape and are expanded from inside outwardly so that each of said sealing elements is compressed substantially by at least 30–50%.

27. A heat exchanger as defined in claim 3, wherein said substantially triangular passages in said base plates are arranged so that corners of adjacent passages are offset relative to one another in the peripheral direction by substantially 180° in an alternating order.

* * * * *